US006522218B1

(12) United States Patent
McKay

(10) Patent No.: US 6,522,218 B1
(45) Date of Patent: Feb. 18, 2003

(54) SYMMETRIC N×N BRANCH-LINE HYBRID POWER DIVIDER/COMBINER

(75) Inventor: James P. McKay, Manhattan Beach, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/528,073

(22) Filed: Mar. 17, 2000

(51) Int. Cl.[7] ..... H01P 5/12
(52) U.S. Cl. ..... 333/125; 333/117; 333/137
(58) Field of Search ..... 333/125, 117, 333/127, 128, 136, 137; 375/260; 343/778; 342/357

(56) References Cited

U.S. PATENT DOCUMENTS 5,883,552 A * 3/1999 McKay ..... 333/125
6,154,501 A * 11/2000 Friedman ..... 375/260

* cited by examiner

*Primary Examiner*—Robert Pascal
*Assistant Examiner*—Dean Takaoka
(74) *Attorney, Agent, or Firm*—Terje Gudmestad

(57) ABSTRACT

A symmetric N×N branch-line hybrid power divider/combiner has N input ports and N output ports. The divider/combiner divides received powers at each input port and transmits and combines the divided powers to the output ports. The divider/combiner includes N through transmission lines, each coupling a respective input port to a respective output port. The divider/combiner also includes N input branch transmission lines, each coupling a respective input port to a central input node and N output branch transmission lines, each coupling a respective output port to a central output node.

20 Claims, 5 Drawing Sheets

FIG. 3

| | Port Excitation Phase | | | | | | | | | | | | | | |
|---|---|---|---|---|---|---|---|---|---|---|---|---|---|---|---|
| | Input Ports | | | | | | Output Ports | | | | | | | | |
| Mode | 1 | 2 | 3 | ••• | N-1 | N | N+1 | N+2 | N+3 | ••• | 2N-1 | 2N | Equivalent 1-Port Network | $y_{in}$ | $\Gamma$ |
| 1 | 0 | 0 | 0 | ••• | 0 | 0 | 0 | 0 | 0 | ••• | 0 | 0 | open, 45°, $y_t$, $y_b$, 45°, open | $j(y_b + y_t)$ | $\phi$ |
| 2 | 0 | 0 | 0 | ••• | 0 | 0 | $\pi$ | $\pi$ | $\pi$ | ••• | $\pi$ | $\pi$ | short, 45°, $y_t$, $y_b$, 45°, open | $j(y_b - y_t)$ | $\phi$ |
| 3 | 0 | $\frac{2}{N}\pi$ | $\frac{4}{N}\pi$ | ••• | $\frac{2N-4}{N}\pi$ | $\frac{2N-2}{N}\pi$ | 0 | $\frac{2}{N}\pi$ | $\frac{4}{N}\pi$ | ••• | $\frac{2N-4}{N}\pi$ | $\frac{2N-2}{N}\pi$ | open, 45°, $y_t$, $y_b$, 45°, short | $-j(y_b - y_t)$ | $\phi$ |
| 4 | 0 | $\frac{2}{N}\pi$ | $\frac{4}{N}\pi$ | ••• | $\frac{2N-4}{N}\pi$ | $\frac{2N-2}{N}\pi$ | $\pi$ | $\frac{N+2}{N}\pi$ | $\frac{N+4}{N}\pi$ | ••• | $\frac{3N-4}{N}\pi$ | $\frac{3N-2}{N}\pi$ | short, 45°, $y_t$, $y_b$, 45°, short | $-j(y_b + y_t)$ | $\phi$ |
| 5 | 0 | $\frac{4}{N}\pi$ | $\frac{6}{N}\pi$ | ••• | $\frac{2N-2}{N}\pi$ | $\frac{2}{N}\pi$ | 0 | $\frac{4}{N}\pi$ | $\frac{6}{N}\pi$ | ••• | $\frac{2N-2}{N}\pi$ | $\frac{2}{N}\pi$ | open, 45°, $y_t$, $y_b$, 45°, short | $-j(y_b - y_t)$ | $\phi$ |
| 6 | 0 | $\frac{4}{N}\pi$ | $\frac{6}{N}\pi$ | ••• | $\frac{2N-2}{N}\pi$ | $\frac{2}{N}\pi$ | $\pi$ | $\frac{N+4}{N}\pi$ | $\frac{N+6}{N}\pi$ | ••• | $\frac{3N-2}{N}\pi$ | $\frac{N+2}{N}\pi$ | short, 45°, $y_t$, $y_b$, 45°, short | $-j(y_b + y_t)$ | $\phi$ |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 2N-1 | 0 | $\frac{2N-2}{N}\pi$ | $\frac{2}{N}\pi$ | ••• | $\frac{2N-6}{N}\pi$ | $\frac{2N-4}{N}\pi$ | 0 | $\frac{2N-2}{N}\pi$ | $\frac{2}{N}\pi$ | ••• | $\frac{2N-6}{N}\pi$ | $\frac{2N-4}{N}\pi$ | open, 45°, $y_t$, $y_b$, 45°, short | $-j(y_b - y_t)$ | $\phi$ |
| 2N | 0 | $\frac{2N-2}{N}\pi$ | $\frac{2}{N}\pi$ | ••• | $\frac{2N-6}{N}\pi$ | $\frac{2N-4}{N}\pi$ | $\pi$ | $\frac{3N-2}{N}\pi$ | $\frac{N+2}{N}\pi$ | ••• | $\frac{3N-6}{N}\pi$ | $\frac{3N-4}{N}\pi$ | short, 45°, $y_t$, $y_b$, 45°, short | $-j(y_b + y_t)$ | $\phi$ |

SYMMETRIC N×N BRANCH-LINE HYBRID POWER DIVIDER/COMBINER

TECHNICAL FIELD

The present invention relates generally to passive microwave devices, and more particularly, to a symmetric N×N branch-line hybrid power divider/combiner.

BACKGROUND ART

Microwave devices are generally divided into the broad categories of passive and active devices. Included under the heading of passive microwave devices are microwave hybrids and microwave couplers that are multi-port networks that are specifically configured for signal routing between the network ports. A device port into which power is normally fed is typically referred to as an incident port or an input port. A port from which power is extracted is called a coupled port or an output port and other ports (from which power is not extracted) are called isolated ports.

Microwave hybrids generally divide the power at each of a plurality of input ports transmit each of the divided portions to a respective one of a plurality of output ports and combine the transmitted powers at each output port. Accordingly, microwave hybrids are often called power divider/combiners. These dividers typically have $2^n$ inputs and $2^n$ outputs.

An example of a four-port (2×2) power divider/combiner has two input ports and two output ports. In a perfect equal divider/combiner, the incident power at each input port would be divided into two equal portions which are each transmitted to a respective one of the output ports (i.e., the power division is perfect). None of the incident power would be reflected from the input ports and none of the power at any one of the input ports would be transmitted to the other input ports. This occurs only when the input ports are perfectly matched to their power sources and the isolation between input ports is perfect.

Although most conventional power divider/combiners successfully divide powers received at input ports and combine these divided powers at output ports, they typically include an excessive number of transmission-line members. Their use in microwave circuits, therefore, has a negative effect upon the size and weight of these circuits. This effect is emphasized when the hybrid's transmission-line members are realized in waveguide or coaxial form and the effect is especially costly when such realizations are intended for weight-sensitive applications such as spacecraft.

An example of such a spacecraft application is an antenna array having a beam forming network which includes twenty two coaxial 8×8 hybrid matrices (each hybrid matrix is formed with twelve 2×2 hybrids) and interconnecting transmission lines. Power divider/combiners that can be realized with less transmission-line members and smaller size would present significant cost savings. Also, achieving symmetric N×N (not 2n×2n) branch-line hybrids will significantly reduce size and improve electrical performance.

SUMMARY OF THE INVENTION

It is, therefore, an object of the invention to provide an improved and reliable symmetric N×N branch-line hybrid. Another object of the invention is to provide reduced cost while improving electrical performance.

In one aspect of the invention, a symmetric N×N branch-line hybrid power divider/combiner has N input ports and N output ports. The divider/combiner divides received powers at each input port and transmits and combines the divided powers to the output ports. The divider/combiner includes N through transmission lines, each coupling a respective input port to a respective output port. The divider/combiner also includes N input branch transmission lines, each coupling a respective input port to a central input node and N output branch transmission lines, each coupling a respective output port to a central output node.

The present invention thus achieves an improved symmetric N×N branch-line hybrid power divider/combiner. The present invention is advantageous in that it provides weight, volume and insertion loss advantages relative to conventional implementations. Additionally, the greater symmetry of these networks provide cost advantages due to simpler design, manufacture and test.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which:

FIG. 3 is the general form of an even/odd mode table for a symmetric N×N branch-line hybrid power divider/combiner according to one embodiment of the present invention;

BEST MODES FOR CARRYING OUT THE INVENTION

Figure 1:
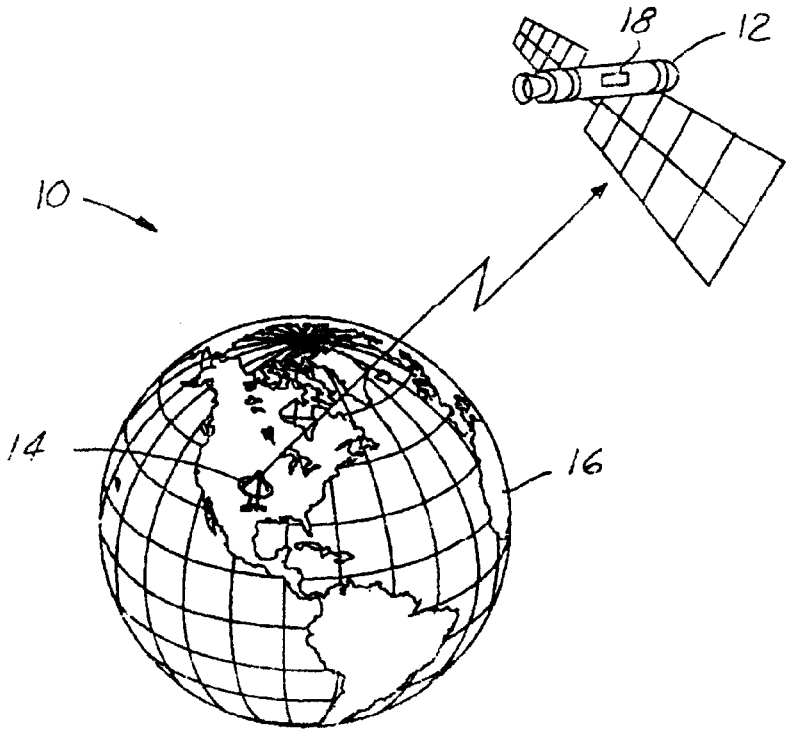
FIG. 1 is a perspective view of a satellite divider/combiner system according to one embodiment of the present invention.

Referring to FIG. 1, a perspective view of a satellite divider/combiner system 10 according to one embodiment of the present invention is illustrated. Satellite divider/combiner system 10 is comprised of one or more satellites 12 in communication with a ground station 14 located on the Earth 16. Each satellite 12 contains one or more symmetric N×N branch-line power hybrid power divider/combiners 18.

Figure 2:
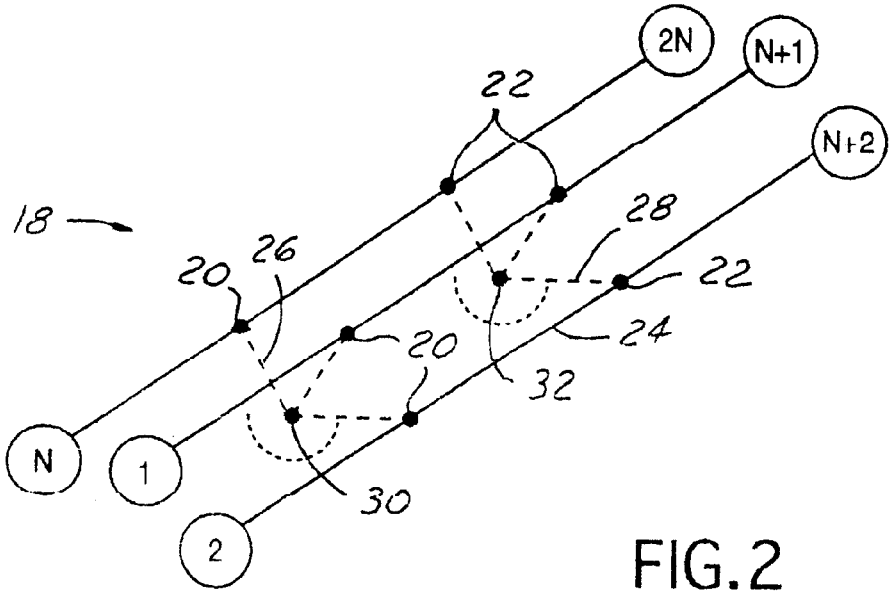
FIG. 2 is a graphical representation of a symmetric N×N branch-line hybrid power divider/combiner according to one embodiment of the present invention.

Referring now to FIG. 2, a graphical representation of a symmetric N×N branch-line hybrid power divider/combiner 18 according to one embodiment of the present invention is illustrated Hybrid 18 is designed to operate at a given guide wavelength $\lambda_g$. N input ports 20 are numbered 1, 2, . . . N, and N output ports 22 are numbered (N+1), (N+2), . . . 2N. Hybrid 18 includes N quarter-wavelength (through length $=\lambda_g/4$) through transmission lines 24 of normalized characteristic admittance $y_t$ with a through electrical length of $\Theta_t=90°$. Hybrid 18 also includes 2N eighth-wavelength (through length$=\lambda_g/8$) branch transmission lines of normalized characteristic admittance $y_b$ with a branch electrical length of $\Theta_b=45°$.

The 2N branch transmission lines are made up of N input branch transmission lines 26 and N output branch transmission lines 28. Input branch transmission lines 26 couple input ports 20 to a central input node 30. Output branch transmission lines 28 couple output ports 22 to a central output node 32. When N=2, hybrid 18 simplifies to a conventional branch line hybrid, since a conventional 2×2 branch-line hybrid is the simplest member of the more general class of networks presented here.

The transmission line characteristic admittances for achieving zero return loss, perfect isolation and a desired coupling level are given below. Through transmission lines 24 have a through electrical length of $\theta_t=90°$, while branch transmission lines have a branch electrical length of $\theta_t=45°$, and $y_t^2-y_b^2=1$. Because of the network symmetry, power is coupled in an equal amount $P_C$ (coupled power) from each through transmission line 24 to each of the remaining (N−1) through transmission lines 24 according to the formula $P_c=\{2/N\cdot\cos(\phi)\}^2$, where $\phi=2\cdot\tan^{-1}(y_t-Y_b)$. Due to the conservation of power, the through power (through power from input port i to output port (N+i)) $P_t=1-(N-1)P_C$. The maximum coupling available $\{P_c/P_t\}_{max}=\{1+N(N/4-1)\}^{-1}$, where the maximum coupling power decreases as the number of coupled lines N increases.

For example, a 9-to-1 beam-forming network which combines 1 strong signal with 8 much weaker signals using conventional technology requires a proximity coupler, seven 2×2 hybrids, and additional transmission lines for signal routing. The equivalent beam-forming network using the current implementation with a 9×9 branch-line hybrid, however, replaces the proximity coupler, 2×2 hybrids, and interconnecting transmission lines. A 9×9 hybrid according to the present invention requires only 9 quarter-wavelength through transmission lines 24 and eighteen eighth-wavelength lines 26 and 28, as compared with the thirty quarter-wavelength lines and additional interconnecting lines which comprise a traditional implementation.

The present invention displays two types of electromagnetic symmetry. First, there is a plane of symmetry that divides the network into two identical halves, one half containing all the input ports 20, and the other half containing all the output ports 22. Each pair of ports 20 and 22 positioned directly across the plane of symmetry from one another are referred to as an input/output pair. Second, the present invention exhibits 2N-fold symmetry, in the sense that the input impedance looking into every port is identical.

Because of these symmetries, the network performance can be determined using an even/odd mode analysis. More specifically, the response of the present invention can be obtained as the superposition of the responses to 2N different symmetric excitation modes. Analysis of the N×N network then simplifies to the analysis of several 1-port networks.

Each mode is generated by exciting all 2N ports simultaneously, each port being excited with amplitude 1/2N. The modes are differentiated from one another by virtue of different port phase excitations. The superposition of the 2N modes is equivalent to exciting only a single port, say port 1, with a voltage wave of magnitude $|V|=1$ and phase angle of $\angle V=0°$.

Referring now to FIG. 3, the general form of an even/odd mode table for a symmetric N×N branch-line hybrid power divider/combiner according to one embodiment of the present invention is illustrated. An even/odd mode table can be created in order to simplify the analysis. The even/odd mode table contains 2N rows, each row containing information about a different excitation mode. More specifically, each row contains the mode number, the port excitation that generates the mode, the equivalent 1-port network that the hybrid simplifies to, and the input admittance $y_{in}$ and input reflection coefficient Γ of the 1-port network. To facilitate a graphical analysis of the network response, the reflection coefficients are shown in vector form relative to a unit circle.

The invention provides N simultaneous equal couplings from each of N transmission lines to each of the remaining (N−1) transmission lines, with zero return loss and perfect isolation at the center design frequency. With conventional technology, when N>3, or when N>2 and the desired output amplitude distribution is non-uniform, there is no other means for performing this function. Thus, the invention represents a new capability not previously available.

Figure 4:
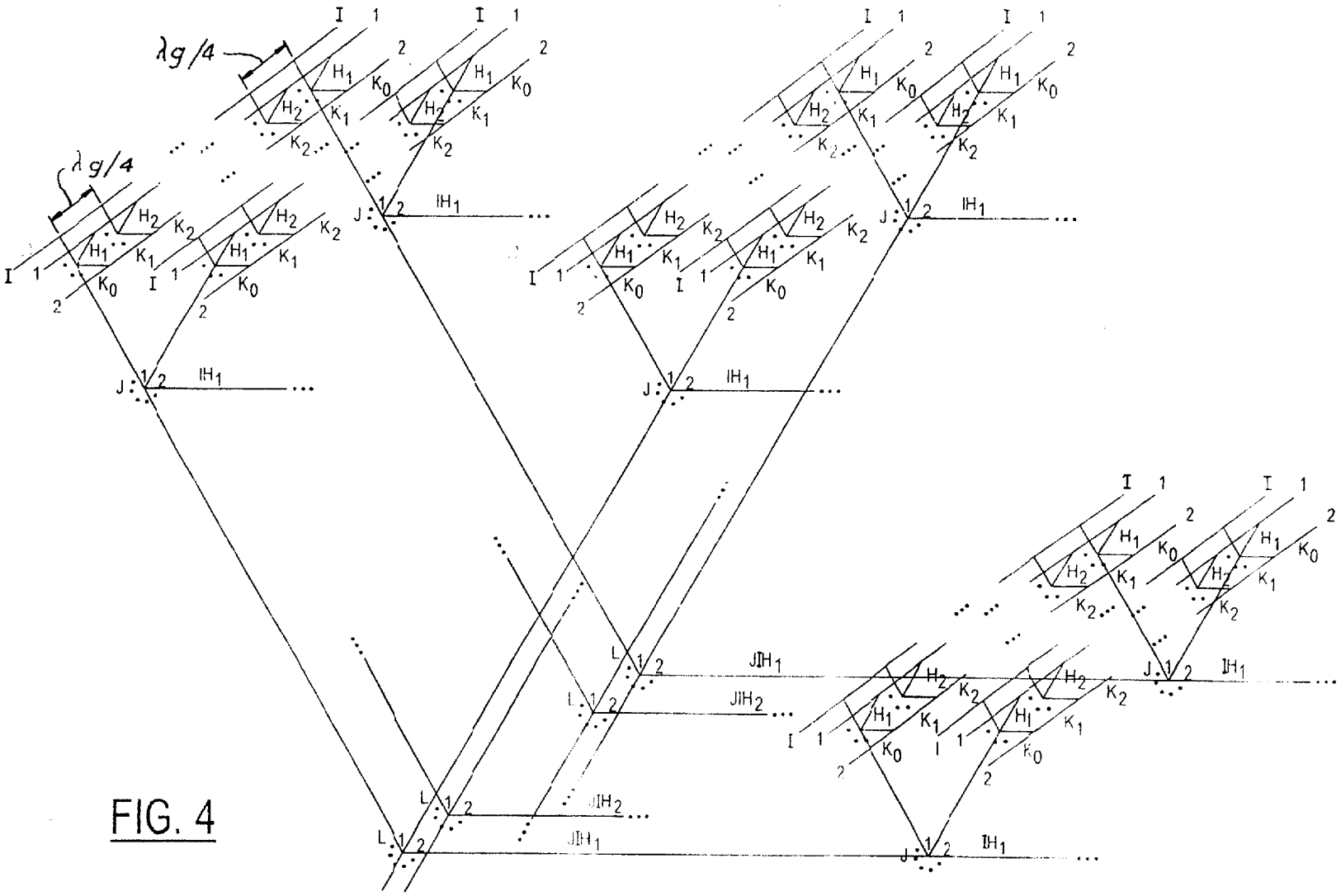
FIG. 4 is a graphical representation of a general structure of an N×N branch-line hybrid power divider/combiner according to one embodiment of the present invention.

Referring to FIG. 4, a graphical representation of a general structure of an N×N branch-line hybrid power divider/combiner according to one embodiment of the present invention is illustrated. The input impedance seen at each port is identical, and all through line lengths are $1=\lambda_g/4$. The lengths of the branch lines that have one end attached to a through line are $1=m\lambda_g/8$, and the lengths of the remaining branch lines are $1=n\lambda_g/4$, where m and n are odd (positive) integers. To maintain symmetry, the integer $n_J$ must be the same for each group of J lines, the integer $n_L$ must be the same for each group of L lines, etc. In general, the integers $m_I$, $n_J$, $n_L$, etc. can all be different. The line characteristic immitances $H_i$, (i=1, 2, . . . ) and $K_i$, (i=0, 1, 2, . . . ) are the same as those required for any conventional 2×2 branch-line hybrid, and can be obtained from the literature. Note that when N=I=2, the network reduces to a conventional 2×2 branch-line hybrid.

Additionally, if all but one input port is terminated, the invention can provide coupling from one transmission line to N−1 other lines. When used in this manner, the invention provides significant (typically 50% or more) reduction in weight and insertion loss relative to a conventional implementation.

Figure 5A:
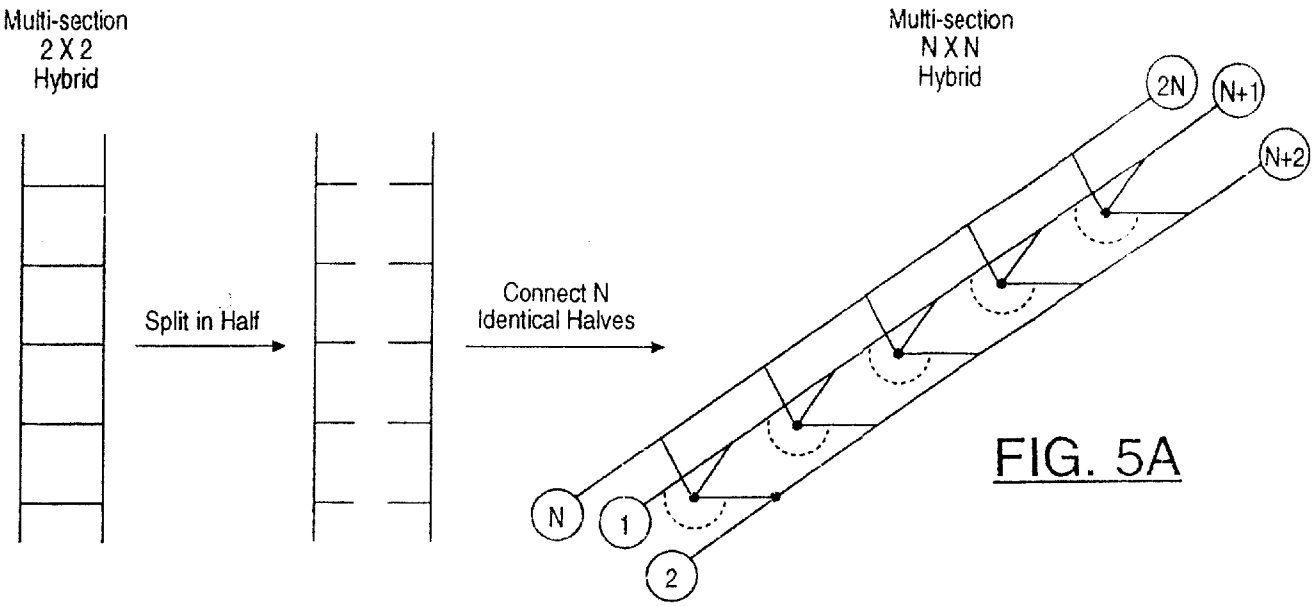
FIG. 5A is an illustration of a method for deriving a multi-section N×N hybrid from a conventional multi-section 2×2 hybrid according to one embodiment of the present invention.

Referring to FIG. 5A, an illustration of a method for deriving a multi-section N×N hybrid from a conventional multi-section 2×2 hybrid according to one embodiment of the present invention is shown. Generally, a multi-section N×N branch-line hybrid can be derived from a conventional multi-section 2×2 branch-line hybrid. The input ports are numbered from 1 to N, and the output ports are numbered from (N+1) to 2N. This allows the utilization of formulas and tables for conventional hybrids available in the prior art. These multi-section hybrids can be useful for increasing the coupling or bandwidth beyond what is available using a single section hybrid.

Figure 5B:
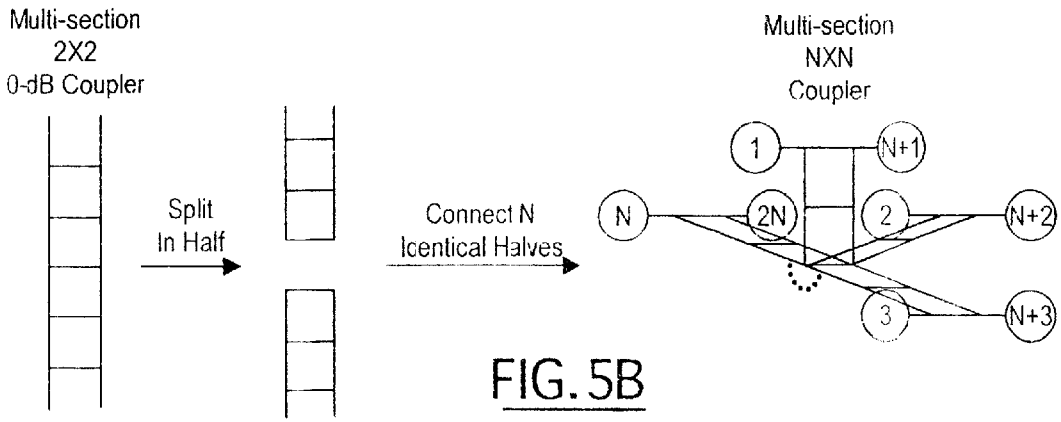
FIG. 5B is an illustration of a method for deriving a multi-section N×N coupler from a conventional multi-section 0-dB 2×2 coupler according to one embodiment of the present invention.

Referring to FIG. 5B, an illustration of a method for deriving a multi-section N×N coupler from a conventional multi-section 0-dB 2×2 coupler according to one embodiment of the present invention is shown. The input ports are numbered 1, 2, 3, . . . , N, and the output ports are numbered (N+1), (N+2), (N+3), . . . 2N. The characteristic admittance of the central branch line is equal to N/2 times the characteristic admittance of the central branch line of the associated 2×2 coupler. When the associated 2×2 coupler has an even number of branches, the N×N coupler has no central branch line.

Figure 6:
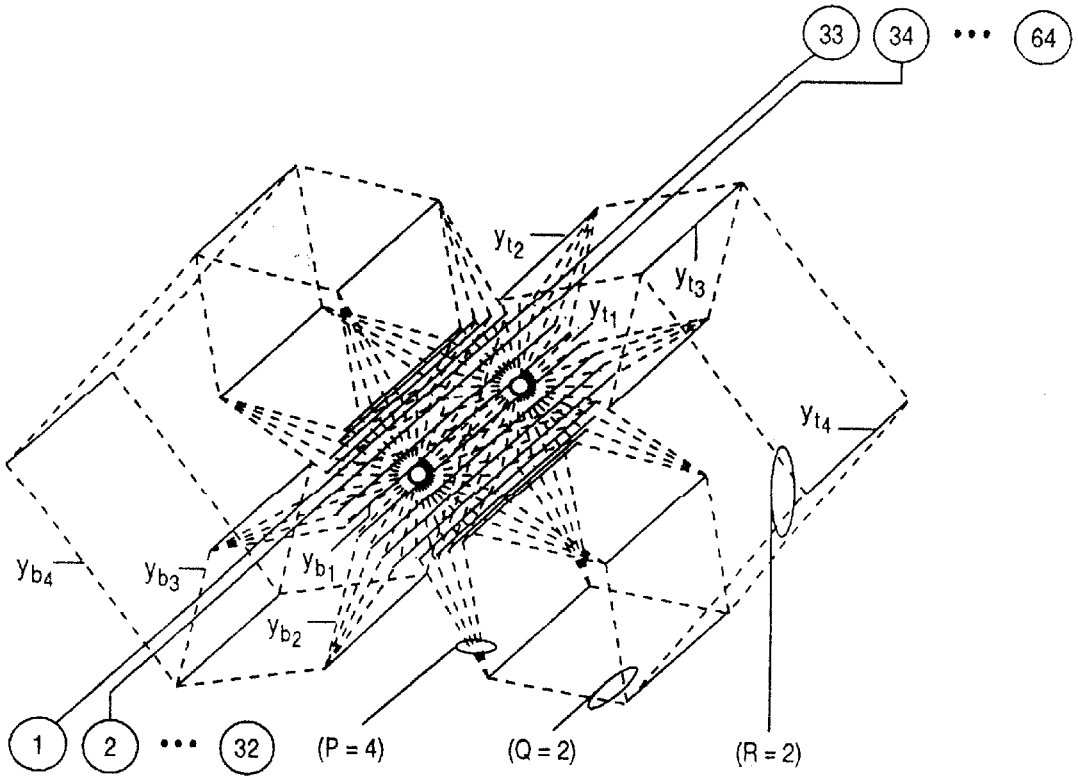
FIG. 6 is a graphical representation of a thirty-two by thirty-two branch-line coupler having additional branch lines for strong coupling according to one embodiment of the present invention.

An example of an N×N branch-line coupler, where N=32, P=4, Q=2, R=2, and S=0, having additional branch lines for strong coupling according to one embodiment of the present invention is illustrated in FIG. 6. It is important to remember that electromagnetic symmetry must be maintained, i.e., the input impedance looking into every port must be identical. Through lines are indicated by solid lines, while dashed lines indicate branch lines. All line lengths are one-quarter wavelength, except for the lines having characteristic admittance $y_{b1}$, which are one-eighth wavelengths. One skilled in the art would realize that a network architecture for arbitrary N, P, Q, R, S, . . . , etc. should be apparent from FIG. 6.

The amount of coupling that can be achieved using these couplers decreases as the number N of coupled lines increases. When N>4, uniform coupling to all output ports is not possible without using additional branch lines. The addition of more branch lines to increase the coupling is illustrated in FIG. 6 for a single-section (narrowband) coupler having N=32. Referring to FIG. 6, the normalized transmission line characteristic admittances satisfy the equations;

$$(y_{l_1}-y')^2-y_{b_1}{}^2=1$$

where;

$$\text{if } Q=0,\ y'=y_{b_2}{}^2/(y_{l_2}/P)$$

$$\text{if } R=0,\ y'=y_{b_2}{}^2/[(y_{l_2}/P)-y_{b_3}{}^2/(y_{l_3}/Q)]$$

$$\text{if } S=0,\ y'=y_{b_2}{}^2/\{(y_{l_2}/P)-y_{b_3}{}^2/[y_{l_3}/Q-y_{b_4}{}^2/(y_{l_4}/R)]\}$$

etc.

From the foregoing, it can be seen that there has been brought to the art a new and improved symmetric N×N branch-line hybrid. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A symmetric N×N branch-line hybrid power divider/combiner having N input ports and N output ports, said divider/combiner dividing received powers at each of N input ports, transmitting and combining the divided powers to N output ports, where N is greater than or equal to 3 and not equal to powers of 2, said divider/combiner comprising:

N through transmission lines, each coupling a respective one of said input ports to a respective one of said output ports;

N input branch transmission lines, each coupling a respective one of said input ports to a central input node; and N output branch transmission lines, each coupling a respective one of said output ports to a central output node.

2. A symmetric N×N branch-line hybrid power divider/combiner as recited in claim 1, wherein said transmission lines are waveguides.

3. A symmetric N×N branch-line hybrid power divider/combiner as recited in claim 1, wherein said transmission lines are coaxial lines.

4. A symmetric N×N branch-line hybrid power divider/combiner as recited in claim 1, wherein said transmission lines are planar transmission lines.

5. A symmetric N×N branch-line hybrid power divider/combiner as recited in claim 1, wherein said through transmission lines have substantially a same through length and are approximately twice a same branch length of said branch transmission lines.

6. A symmetric N×N branch-line hybrid power divider/combiner as recited in claim 5 configured for operation with signals having a guide wavelength $\lambda_g$, said through transmission lines having a through length of substantially $\lambda_g/4$, and said branch transmission lines having a branch length of substantially $\lambda_g/8$.

7. A symmetric N×N branch-line hybrid power divider/combiner as recited in claim 1, wherein said through transmission lines have a normalized characteristic admittance $y_t$ and said branch transmission lines have a normalized characteristic admittance $y_b$, wherein $y_t^2-y_b^2=1$.

8. A symmetric N×N branch-line hybrid power divider/combiner as recited in claim 1, wherein said through transmission lines have an electrical length $\theta_t$ and said branch transmission lines have an electrical length of $\theta_b$, wherein $\theta_t=90°$ and $\theta_b=45°$.

9. A symmetric N×N branch-line hybrid power divider/combiner as recited in claim 1, wherein a through power $P_t$ is coupled from an input port i to an output port (N+i) and a coupled power $P_c$ is coupled to the remaining N−1 output ports, said $P_t$ and $P_c$ related by an equation of $\{P_c/P_t\}_{max}=\{1+N(N/4-1)\}^{-1}$ where $P_t=1-(N-1)P_c$.

10. A symmetric N×N branch-line hybrid power divider/combiner as recited in claim 1, wherein a through power $P_t$ is coupled from an input port i to an output port (N+i) and a coupled power $P_c$ is coupled to the remaining N−1 output ports, said coupled power $P_c=\{2/N\cdot\cos(\Phi)\}^2$ where $\Phi=2\tan^{-1}(y_t-y_b)$.

11. A satellite divider/combiner system, comprising:

a ground station;

a satellite in orbit and in communication with said ground station, said satellite having a symmetric N×N branch-line hybrid power divider/combiner having N input ports and N output ports, where N is greater than or equal to 3 and not equal to powers of 2, said divider/combiner comprising:

N through transmission lines, each coupling a respective one of said input ports to a respective one of said output ports;

N input branch transmission lines, each coupling a respective one of said output ports to a central output node; an N output branch transmission lines, each coupling a respective one of said output ports to a central output node.

12. A satellite divider/combiner system as recited in claim 11, wherein said transmission lines are waveguides.

13. A satellite divider/combiner system as recited in claim 11, wherein said transmission lines are coaxial lines.

14. A satellite divider/combiner system as recited in claim 11, wherein said transmission lines are planar transmission lines.

15. A satellite divider/combiner system as recited in claim 11, wherein said through transmission lines have substantially a same through length and are approximately twice a same branch length of said branch transmission lines.

16. A satellite divider/combiner system as recited in claim 15 configured for operation with signals having a guide wavelength $\lambda_g$, said through transmission lines having a through length of substantially $\lambda_g/4$, and said branch transmission lines having a branch length of substantially $\lambda_g/8$.

17. A satellite divider/combiner system as recited in claim 11, wherein said through transmission lines have a normalized characteristic admittance $y_t$ and said branch transmission lines have a normalized characteristic admittance $y_b$, wherein $y_t^2-y_b^2=1$.

18. A satellite divider/combiner system as recited in claim 11, wherein said through transmission lines have an electrical length $\theta_t$ and said branch transmission lines have an electrical length of $\theta_b$, wherein $\theta_t=90°$ and $\theta_b=45°$.

19. A satellite divider/combiner system as recited in claim 11, wherein a through power $P_t$ is coupled from an input port i to an output port (N+i) and a coupled power $P_c$ is coupled to the remaining N−1 output ports, said $P_t$ and $P_c$ related by an equation of $\{P_c/P_t\}_{max}=\{1+N(N/4-1)\}^{-1}$ where $P_t=1-(N-1)P_c$.

20. A satellite divider/combiner system as recited in claim 11, wherein a through power $P_t$ is coupled from an input port i to an output port (N+i) and a coupled power $P_c$ is coupled to the remaining N−1 output ports, said coupled power $P_c=\{2/N\cdot\cos(\Phi)\}^2$ where $\Phi=2\tan^{-1}(y_t-y_b)$.

* * * * *